United States Patent [19]

Dubach

[11] Patent Number: 5,052,584

[45] Date of Patent: Oct. 1, 1991

[54] CHILDPROOF PILL DISPENSER

[75] Inventor: Werner F. Dubach, Maur, Switzerland

[73] Assignee: Firma Createchnic AG, Switzerland

[21] Appl. No.: 500,472

[22] Filed: Mar. 28, 1990

[30] Foreign Application Priority Data

Apr. 4, 1989 [CH] Switzerland ..... 01224/89

[51] Int. Cl.[5] ..... B65D 83/00

[52] U.S. Cl. ..... 221/152; 221/4; 221/190; 222/153; 206/536

[58] Field of Search ..... 221/4, 151, 152, 190, 221/88, 89; 206/536, 537; 222/402.11, 153, 160

[56] References Cited

U.S. PATENT DOCUMENTS

| | | | |
|---|---|---|---|
| 2,828,005 | 3/1958 | Ricke | 221/89 |
| 3,601,290 | 8/1971 | Nigro | 222/402.11 |
| 3,756,467 | 9/1973 | Anketell | 222/153 |
| 3,762,539 | 10/1973 | Kerr | 206/537 |
| 4,418,842 | 12/1983 | Di Loreto | 222/402.11 |
| 4,566,611 | 1/1986 | Sukopp | 222/402.11 |
| 4,773,567 | 9/1988 | Stoody | 222/402.11 |
| 4,854,478 | 8/1989 | Gyimothy . | |

*Primary Examiner*—H. Grant Skaggs
*Attorney, Agent, or Firm*—Thomas W. Speckman; Douglas H. Pauley

[57] ABSTRACT

A pill dispenser having two cylindrical main components that fit into one another, an inner concentric wall and an outer concentric wall displaceable relative to one another in a direction of a longitudinal axis of the pill dispenser. The outer concentric wall or the inner concentric wall has at least one recess and a counterpart is positioned on the other concentric wall so that the one main component of the pill dispenser is moveable within the recess upon actuation of the pill dispenser whenever the two main components are aligned in a suitable angular position with respect to one another.

7 Claims, 3 Drawing Sheets

CHILDPROOF PILL DISPENSER

BACKGROUND OF THE INVENTION

1. Field of the Invention

The present invention relates to a pill dispenser that includes two cylindrical main components fitting into one another and that has concentric walls that are displaceable relative to one another in the direction of the longitudinal axis.

2. Description of the Prior Art

A pill dispenser of this generic type is described by U.S. Pat. No. 4,854,478. The pill dispenser described cannot be rotated into any relative angular position of the two main components.

Until now, pill dispensers were used almost entirely for small tablets of simple contour. Such tablets were predominantly harmless in nature, such as candy or ascorbic acid tablets. Pill dispensers in accordance with the aforementioned U.S. Pat. No. 4,854,478 also allow larger pills of complex shape, such as those used for pharmaceutical purposes, to be dispensed.

SUMMARY OF THE INVENTION

For such purposes, the authorities usually require childproof packaging. It is an object of the present invention to improve a pill dispenser of the generic type above in such a way that it is childproof.

This object is achieved with a pill dispenser having two cylindrical main components that fit into one another and walls extending concentrically relative to one another and displaceable relative to one another, in a direction of a longitudinal axis of the pill dispenser. The outer concentric wall or the inner concentric wall of the main components have at least one recess into which a counterpart of the other main component of the pill dispenser is movable upon the actuation of the pill dispenser whenever the main components, which are rotatable relative to one another, are aligned in a suitable angular position with respect to one another. Further embodiments of the invention are further described below. The advantages and operation of this invention are described in the ensuing description, referring to the accompanying drawing wherein:

DESCRIPTION OF THE PREFERRED EMBODIMENTS

Figure 1:
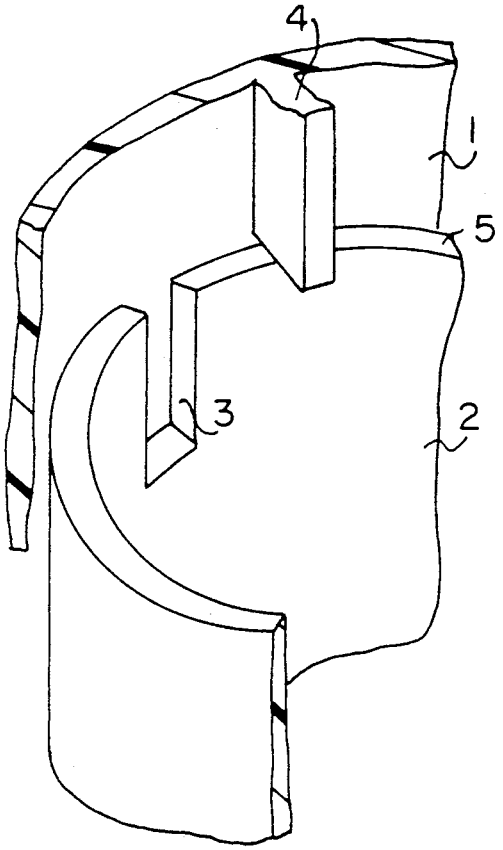
FIG. 1 is a perspective view of a cutaway portion of a pill dispenser.

Intentionally, the entire structure of the pill dispenser has been not shown in the drawings. For the entire structure, reference is made to U.S. Pat. No. 4,854,478, which represents the prior art.

The two main components of the pill dispenser of this invention each have cylindrical wall 1 and 2, respectively. Cylindrical walls 1 and 2 are aligned concentrically with one another and move relative to one another in the direction of the longitudinal axis of the dispenser, when the pill dispenser is actuated. The longitudinal ribs that are typically present on at least one of the two main components and that enable rotation of the two main components, relative to one another, have been left out. The term "main components" has been selected in order to express the fact that in addition to the main components the pill dispenser can have other parts as well, but the other parts are not significant to the present invention. Any main component may also comprise a plurality of elements.

In the simplest embodiment as shown in FIG. 1, wall 2 of the lower component has a small diameter and has recess 3. In such embodiment, recess 3 is a slit. If wall 2 is relatively thick, however, recess 3 could merely be a groove on the outside of concentric wall 2. Counterpart 4, facing inward, is positioned on the inside surface of outer concentric wall 1 of the upper main component of the pill dispenser. When the pill dispenser is not pressed together, not actuated, counterpart 4 is located above upper edge 5 of the inner concentric wall and at least partly protrudes past upper edge 5. This arrangement assures the relative rotatability of the two main components. Counterpart 4 may be a simple cam, a pin, or as in an embodiment shown in the drawings, an approximately radially oriented rib. Markings, not shown in the drawings, are provided on the outside surfaces of concentric walls 1 and 2. If the markings of the two main components are made to coincide by rotating the two main components relative to one another, then counterpart 4 is located precisely above recess 3, and the pill dispenser can be actuated by pressing the two main components together.

Figure 2:
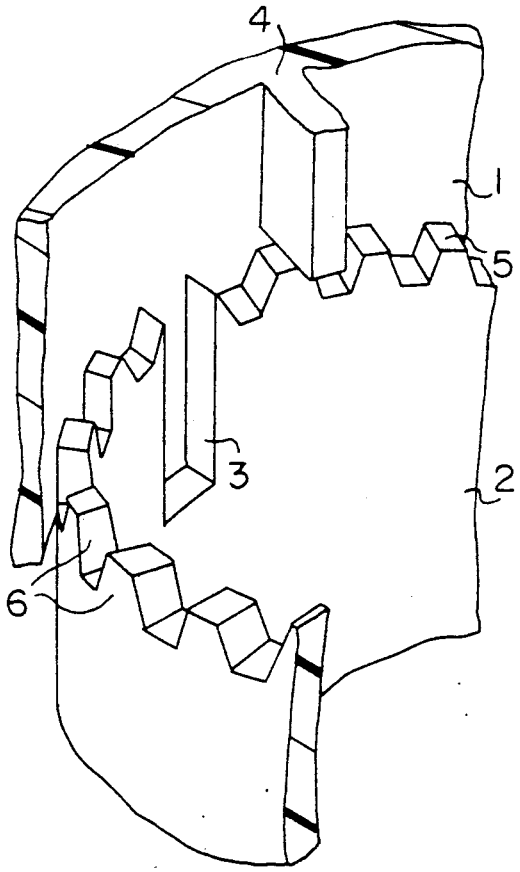
FIG. 2 is the same view as FIG. 1 of another embodiment of a pill dispenser having a tracer-like safety device.
Figures 3A, 3B:
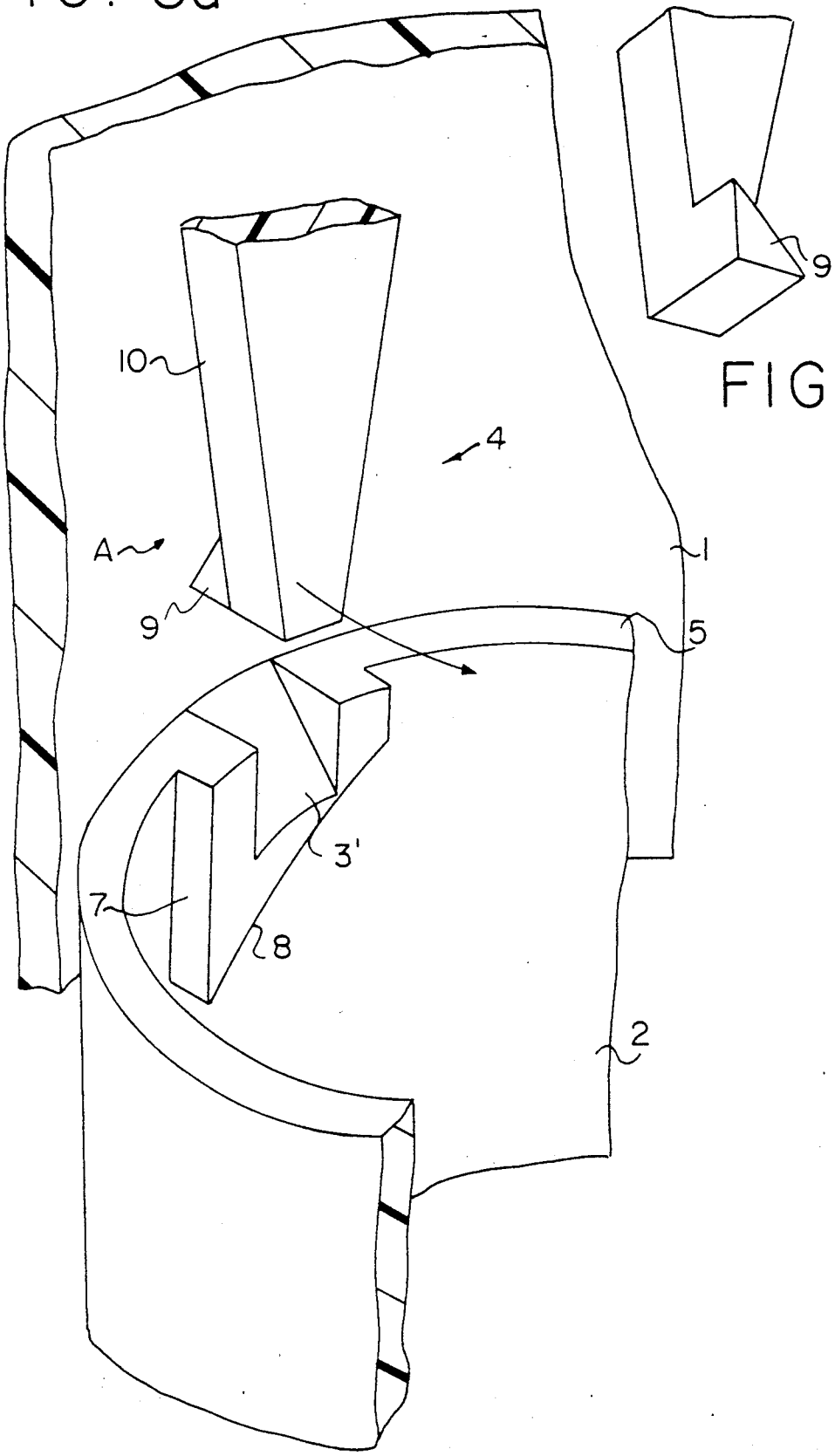
FIG. 3*a* is the same view as FIG. 1 of another embodiment of a pill dispenser having an automatic return to a childproof position.
FIG. 3*b* is a perspective view of one part seen in a direction of arrow A as shown in FIG. 3*a*.
Figure 4B:
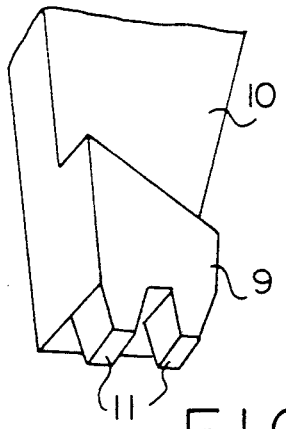
FIGS. 4*a* and 4*b* are views similar to FIGS. 3*a* and 3*b*, of another embodiment of a pill dispenser having a tracerlike safety device, as shown in FIG. 2.
Figure 4A:
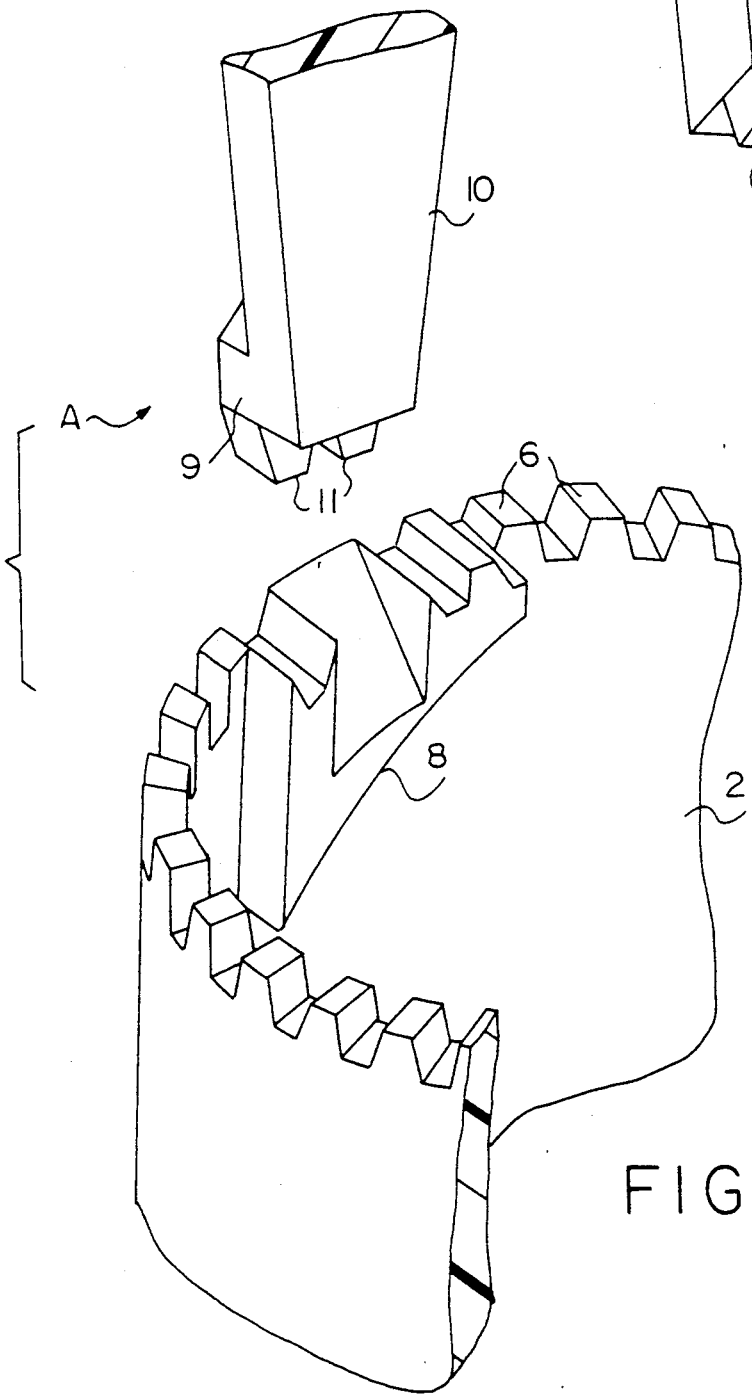

However, such embodiment allows the possibility that a child at play might rotate the two main components counter to one another with slight pressure until counterpart 4 accidentally snaps in place, into recess 3; the child could then actuate the dispenser. One embodiment for preventing such accidental actuation is shown in FIG. 2. Upper edge 5 of inner concentric wall 2 has, for such purpose, tooth-like protrusions 6, between which counterpart 4, or in the example shown the rib, can snap into place, thus making the described relative rotation under pressure impossible. The embodiments described so far are also quite suitable as safety provisions to prevent unintentional actuation during shipment or when the dispenser is carried.

In the embodiments described above, if the user forgets to rotate the two main components relative to one another, after each actuation, the dispenser is no longer childproof, and it can be actuated repeatedly at will in the position established. Such feature may be advantageous under some circumstances, for instance for the sick and elderly, where there are no children in the vicinity and for whom unlocking the device is more of an effort.

The two embodiments shown in FIGS. 3*a*, 3*b*, 4*a* and 4*b* generate an automatic movement into a childproof position after each actuation. In these embodiments, inner concentric wall 2 has an inwardly protruding thickened wall portion 7.

A ramp recess 3', inclined downward and inward from upper outer edge 5, extends in the vicinity of wall portion 7. Thickened wall portion 7 has edge 8 extending at right angles to inner concentric wall 2. Edge 8 forms a slide face, which is inclined in at least one rotational direction.

Counterpart 4 is attached to the other main component having outer concentric wall 1. In this embodiment, counterpart 4 must be resilient in the radial direction and must have a tracer device 9 on its end, which in the return stroke of the reciprocation engages lower edge 8 of thickened wall portion 7 from below. Counterpart 4 may be either leg 10 secured to the main component having outer concentric wall 1, or a buttress disposed on the inside surface of outer concentric wall 1 in a spaced-apart manner.

As in the previous embodiment, in order to actuate the pill dispenser the two main components must be rotated relative to one another, until the markings, again not shown in the drawings, on concentric wall 1 are aligned with one another. Pressing on the pill dispenser then causes the radially resilient counterpart 4 to move with its tracer device 9 into the recess 3', thus sliding inward deflectingly over the ramp surface of recess 3', until finally tracer device 9 moves out of recess 3' and snaps resiliently outward again, engaging lower edge 8 of thickened portion 7 from below. Under the spring force of the pill dispenser, the two main components move axially apart from one another again, in the course of which they necessarily also rotate relative to one another until tracer device 9 has slipped past inclined lower edge 8 of thickened wall portion 7. The inclination of lower edge 8 must be sufficient to prevent self-locking.

Once again, with this embodiment it would be possible for a child at play to find the locked position of the pill dispenser by rotating it under pressure. However, this problem can also be solved in the manner already described above. Since the lower surface of tracer device 9 is usually larger than the distance between two adjacent protrusions 6, the underside of tracer device 9 must have a diametrically opposed set of teeth 11.

In such an embodiment, and particularly when the lower edge is inclined in only one rotational direction, it is suitable to provide ratchet-type means on both main components, which allow rotation in only one direction.

This makes it possible to provide the pill dispenser with three or seven recesses 3', for example, so that it can be pressed down in three or seven positions. For pills that must be taken three times a day, for instance, the two main components can first be turned to a "MORNING" marking and the pill dispenser can then be actuated. Afterward, it automatically rotates one increment toward a "NOON" marking. Now the dispenser must be rotated as before, until this marking is reached; then after a further actuation the dispenser rotates toward the "EVENING" marking, after which this process is repeated. The compulsory direction of rotation makes it virtually impossible to unintentionally take two pills at a time. This embodiment can also have seven recesses 3' and seven markings, corresponding to the days of the week.

I claim:

1. In a pill dispenser having two cylindrical main components that fit into one another, an inner concentric wall and an outer concentric wall extending concentrically relative to one another and displaceable relative to one another in a direction of a longitudinal axis of the pill dispenser, the improvement comprising: one of said outer concentric wall (1) and said inner concentric wall (2) of one of said main components having at least one recess (3, 3'), a counterpart (4) on the other of said main components of the pill dispenser being movable within said at least one recess (3, 3') upon actuation of the pill dispenser whenever said main components, which are rotatable relative to one another, are aligned in a suitable angular position with respect to one another; and in a region of an inwardly protruding thickened wall portion (7) of said inner concentric wall (2) said thickened wall portion (7) forming a ramp surface inclined downward toward an inside of the pill dispenser, a lower edge (8) of said thickened wall portion (7) being inclined in at least one rotational direction, a radially resilient counterpart (4, 10) attached to the other of said main components, said counterpart (4) having a tracer device (9) on an end of said counterpart (4), said tracer device (9) fitting into said recess (3'), said tracer device (9) engaging said lower edge (8) from below upon a return stroke of reciprocation of the pill dispenser.

2. In a pill dispenser according to claim 1, wherein said recess (3) of said inner concentric wall (2) extends parallel to said longitudinal axis, said counterpart (4) is movable into said recess (3) and upon movement from said suitable angular position said counterpart (4) rests on said inner concentric wall (2) thereby preventing actuation of the pill dispenser, and a length of said recess (3) is at least equivalent to an actuation travel distance of the pill dispenser.

3. In a pill dispenser according to claim 2, wherein an upper edge (5) of said inner concentric wall (2) has tooth protrusions (6) which allow rotation of said main components only when the pill dispenser is in an uncompressed state.

4. In a pill dispenser according to claim 2, wherein said counterpart (4) is on said outer concentric wall (1) and is a radially aligned rib.

5. In a pill dispenser according to claim 1, wherein an upper edge (5) of said inner concentric wall (2) has a plurality of tooth protrusions (6), and said resilient counterpart (4, 10) has a diametrically opposed set of teeth (11) on a bottom of said tracer device (9).

6. In a pill dispenser according to claim 1, wherein said resilient counterpart (4) further comprises a leg (10) mounted on said main component having said outer concentric wall (1).

7. In a pill dispenser according to claim 1, wherein said lower edge (8) of said thickened wall portion (7) extends upward in one said rotational direction, and said tracer device (9) has a slide face inclined to engage with said lower edge (8) of said thickened wall portion (7).

* * * * *